US008357481B2

(12) United States Patent
Kishida et al.

(10) Patent No.: US 8,357,481 B2
(45) Date of Patent: Jan. 22, 2013

(54) IMAGE FORMING METHOD AND IMAGE FORMING APPARATUS

(75) Inventors: Hiroyuki Kishida, Numazu (JP); Masahide Inoue, Numazu (JP); Hyo Shu, Numazu (JP); Yasutada Shitara, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 664 days.

(21) Appl. No.: 12/546,026

(22) Filed: Aug. 24, 2009

(65) Prior Publication Data

US 2010/0067958 A1 Mar. 18, 2010

(30) Foreign Application Priority Data

Sep. 16, 2008 (JP) ..... 2008-236146

(51) Int. Cl.
*G03G 13/08* (2006.01)

(52) U.S. Cl. ..... 430/124.34; 430/123.5; 399/269; 399/272; 399/325

(58) Field of Classification Search ..... 430/124.34, 430/123.5; 399/269, 272, 325
See application file for complete search history.

(56) References Cited

U.S. PATENT DOCUMENTS 4,980,258 A * 12/1990 Aoki et al. ..... 430/108.2
5,923,933 A * 7/1999 Anzai et al. ..... 399/269
7,022,448 B2 * 4/2006 Yaguchi et al. ..... 430/123.52
7,099,609 B2 * 8/2006 Hirobe et al. ..... 399/269
7,392,000 B2 * 6/2008 Choi ..... 399/267
7,574,164 B2 * 8/2009 Okada et al. ..... 399/269
2006/0083551 A1 * 4/2006 Asano et al. ..... 399/223
2007/0184377 A1 8/2007 Shu et al.

FOREIGN PATENT DOCUMENTS

JP 2005062214 A * 3/2005
JP 2007-241241 9/2007

OTHER PUBLICATIONS

English language machine translation of JP 2005-0662214 (Mar. 2005).*
Borsenberger, Paul M. et al. Organic Photoreceptors for Imaging Systems. New York: Marcel-Dekker, Inc. (1993) pp. 6-17.*
U.S. Appl. No. 12/367,750, filed Feb. 9, 2009, Hiroyuki Kishida.

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

An image forming method including forming an electrostatic latent image on a photoreceptor; developing the latent image with a developer including a toner using a center-feed developing device to form a toner image; transferring the toner image onto a receiving material; and fixing the toner image using a fixing member coated with silicone oil. The toner includes at least a binder resin; a colorant; and a quaternary ammonium salt having a specific formula, wherein when the toner is dispersed in ethanol using ultrasonic waves, the dispersion has a turbidity of from 0.4 to 1.0 when the turbidity is determined using a haze meter. An image forming apparatus including a photoreceptor; a center-feed developing device using a developer including the toner; a transferring device; a fixing device using a fixing member coated with silicone oil; and a cleaner for the photoreceptor.

10 Claims, 1 Drawing Sheet

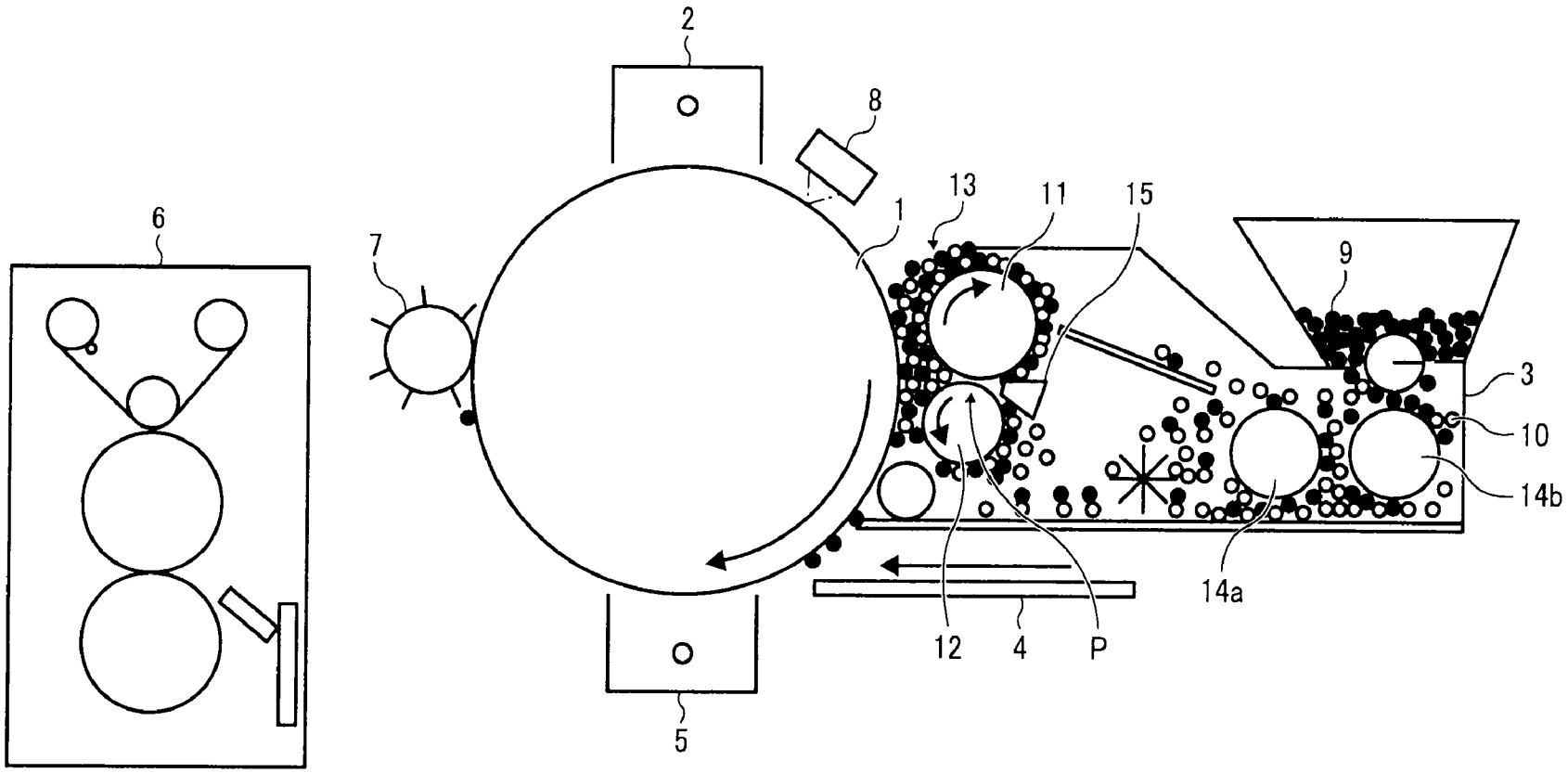
3
10
14b
9
14a
15
P
11
4
13
12
1
8
2
5
7
6

IMAGE FORMING METHOD AND IMAGE FORMING APPARATUS

BACKGROUND OF THE INVENTION

1. Field of the Invention

The present invention relates to an image forming method, and an image forming apparatus.

2. Discussion of the Background

Recently, a need exists for an electrophotographic image forming apparatus such as copiers and printers, which can produce high quality images at a high speed.

In order to perform high speed recording using an electrophotographic image forming apparatus, various techniques have been disclosed. For example, an unexamined Japanese patent application No. 2007-241241 corresponding to US2007184377 discloses a technique such that a toner including a crystalline polyester resin, an amorphous resin, a fatty acid amide, and a colorant is used for an image forming apparatus having a system speed of from 500 to 1700 mm/sec, wherein the ratio (W/R) of the height (W) of the FT-IR peak specific to the crystalline polyester resin to the height (R) of the FT-IR peak specific to the amorphous polyester resin falls in a specific range, and the toner transfer rate falls in a range of from 75 to 100%. It is described therein that the toner has good low temperature fixability and hardly causes a toner filming problem in that a film of toner is formed on the image bearing member, resulting in formation of abnormal images.

It is certain that the image forming apparatus has good low temperature fixability and hardly causes the toner filming problem. Recently, a need exists for further enhancing the fixing property (such as rubbing resistance) of the toner images produced by such an image forming apparatus.

SUMMARY OF THE INVENTION

As an aspect of the present invention, an image forming method is provided. The image forming method includes:

forming an electrostatic latent image on a photoreceptor;

developing the electrostatic latent image with a developer including a toner using a center-feed developing device to prepare a toner image on a surface of the photoreceptor, wherein the center-feed developing device includes at least two developing rollers, which are opposed to the photoreceptor while opposed to each other and rotated in different directions and each of which has a magnetic force, and a developer layer thickness controlling member, which is located on an upstream side from the opposed position of the two developing rollers relative to the rotation directions of the developing rollers and which is configured to control the thicknesses of the developer layers formed on the surfaces of the developing rollers;

transferring the toner image onto a receiving material optionally via an intermediate transfer medium;

fixing the toner image on the receiving material with a fixing member, on which a silicone oil is applied; and cleaning the surface of the photoreceptor after transferring the toner image.

The toner includes at least a binder resin, a colorant, and a quaternary ammonium salt having the following formula (1):

Formula (1)

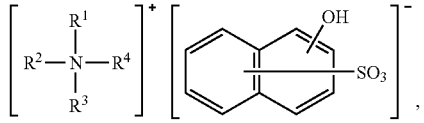

wherein each of $R^1$ to $R^4$ represents a substituted or unsubstituted hydrocarbon group having 1 to 25 carbon atoms, which is optionally branched, wherein when the toner is dispersed in ethanol using ultrasonic waves, the dispersion has a turbidity of from 0.4 to 1.0 when the turbidity (Th) is determined from the following equation:

$$Th=-\log(Tt/100),$$

wherein Tt represents a transmittance of the dispersion measured with a haze meter.

As another aspect of the present invention, an image forming apparatus is provided. The image forming apparatus includes:

a photoreceptor configured to bear an electrostatic latent image;

a developing device configured to develop the electrostatic latent image with a developer including the toner mentioned above to form a toner image on the photoreceptor, wherein the developing device is the center-feed developing device mentioned above;

a transferring device configured to transfer the toner image onto a receiving material optionally via an intermediate transfer medium;

a fixing device configured to fix the toner image on the receiving material using a fixing member, on which a silicone oil is applied; and a cleaner configured to clean the surface of the photoreceptor after the toner image is transferred onto the receiving material.

The receiving material is preferably fed at a speed of from 500 to 2000 mm/sec.

The image forming apparatus preferably includes:

a charging device configured to charge the surface of the photoreceptor; and a light irradiating device configured to irradiate the charged photoreceptor with imagewise light to form an electrostatic latent image on the photoreceptor.

The toner mentioned above is preferably prepared by a pulverization method, which includes:

subjecting toner constituents including at least a binder resin, a colorant, and a quaternary ammonium salt having formula (1) to a melt kneading treatment to prepare a kneaded toner constituent mixture;

cooling the kneaded toner constituent mixture;

crushing the toner constituent mixture to prepare a primary powder;

pulverizing the primary powder to prepare a secondary powder using an air pulverizer, wherein the air pressure is from 6 to 7 atm/cm$^2$; and classifying the secondary powder to prepare particles of the toner.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

FIGURE illustrates an example of the image forming apparatus of the present invention.

DETAILED DESCRIPTION OF THE INVENTION

At first, the image forming method and apparatus of the present invention will be explained.

The image forming method of the present invention includes at least the following processes:

(a) forming an electrostatic latent image on a photoreceptor;
(b) developing the electrostatic latent image with a developer including a toner to form a toner image on the photoreceptor;
(c) transferring the toner image onto a receiving material directly or using an intermediate transfer medium;
(d) cleaning the surface of the photoreceptor to remove residual toner on the photoreceptor after transferring the toner image; and
(e) fixing the toner image on the receiving material using a fixing member, on which a silicone oil is applied.

The image forming method of the present invention preferably includes the following processes:

(1) charging a surface of a photoreceptor serving as an image bearing member;
(2) irradiating the charged photoreceptor with imagewise light to form an electrostatic latent image on the photoreceptor;
(3) developing the electrostatic latent image with a developer including a toner to form a toner image on the photoreceptor;
(4) transferring the toner image onto a receiving material directly or using an intermediate transfer medium;
(5) cleaning the surface of the photoreceptor to remove residual toner on the photoreceptor after transferring the toner image; and
(6) fixing the toner image on the receiving material using a fixing member, on which a silicone oil is applied.

The developing process is performed using a center-feed developing device, which includes:

at least two developing rollers, which are opposed to the photoreceptor while opposed to each other and rotated in different directions and each of which has a magnetic force; and a developer layer thickness controlling member, which is located on an upstream side from the opposed position of the two developing rollers relative to the rotation directions of the developing rollers and which is configured to control the thicknesses of the developer layers formed on the developing rollers.

The toner includes at least a binder resin, a colorant, and a quaternary ammonium salt having the following formula (1):

Formula (1)

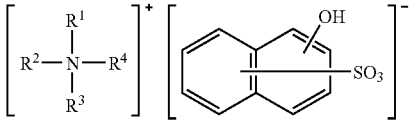

wherein each of $R^1$ to $R^4$ represents a substituted or unsubstituted hydrocarbon group having 1 to 25 carbon atoms, which may be branched.

In addition, when the toner is dispersed in ethanol using ultrasonic waves, the dispersion has a turbidity of from 0.4 to 1.0 when the turbidity (Th) is determined from the following equation:

$$Th=-\log(Tt/100),$$

wherein Tt represents a transmittance of the dispersion measured with a haze meter.

The image forming apparatus of the present invention includes at least the following devices:

(a) a photoreceptor configured to bear an electrostatic latent image;
(b) the above-mentioned center-feed developing device configured to develop the electrostatic latent image with a developer including the above-mentioned toner to form a toner image on the photoreceptor;
(c) a transferring device configured to transfer the toner image onto a receiving material directly or using an intermediate transfer medium;
(d) a fixing device configured to fix the toner image on the receiving material using a fixing member coated with a silicone oil; and
(e) a cleaner configured to clean the surface of the photoreceptor after the toner image is transferred.

The image forming apparatus of the present invention preferably includes the following devices:

(1) a photoreceptor serving as an image bearing member;
(1) a charging device configured to charge a surface of the photoreceptor;
(2) alight irradiating device configured to irradiate the charged photoreceptor with imagewise light to form an electrostatic latent image on the photoreceptor;
(3) the center-feed developing device configured to develop the electrostatic latent image with a developer including the above-mentioned toner to form a toner image on the photoreceptor;
(4) a transferring device configured to transfer the toner image onto a receiving material directly or using an intermediate transfer medium;
(5) a cleaner configured to clean the surface of the photoreceptor to remove residual toner on the photoreceptor; and
(6) a fixing device configured to fix the toner image on the receiving material using a fixing member on which a silicone oil is applied.

Next, the image forming method and apparatus of the present invention will be explained in detail by reference to drawings.

FIGURE illustrates an image forming portion of an example of the image forming apparatus of the present invention.

Referring to FIGURE, a charging device 2 uniformly charges a surface of a drum-form photoreceptor 1 (charging process). Alight irradiating device 8 irradiates the charged photoreceptor 1 with imagewise light to form an electrostatic latent image on the photoreceptor (light irradiating process). In this regard, a combination of the charging process and the light irradiating process is hereinafter sometimes referred to as an electrostatic latent image forming process. A developing device 3 develops the electrostatic latent image with a developer including a carrier 10 and a toner 9 to form a toner image on the photoreceptor 1 (developing process).

Next, a transferring device 5 transfers the toner image onto a receiving material 4, which is timely fed so that the toner image is transferred on a proper position of the receiving material. A fixing device 6 fixes the toner image on the receiving material 4, thereby forming a desired image. Toner particles remaining on the photoreceptor 1 without being transferred onto the receiving material 4 in the transferring process are removed from a cleaner 7 including a cleaning brush.

By repeating these image forming processes, plural recorded images can be produced.

Next, components of the image forming apparatus will be explained.

(Photoreceptor)

Any known inorganic or organic photoreceptors can be used as the photoreceptor 1. The shape of the photoreceptor 1 is not particularly limited, and drum-shaped photoreceptors, belt-shaped photoreceptors and the like can be used. In order to perform high speed image recording, drum-shaped photoreceptors are preferably used.

(Charging Device)

Any known contact chargers and non-contact chargers can be used as the charging device 2.

(Light Irradiating Device)

Any known light irradiating devices, which can form an electrostatic latent image on the photoreceptor 1, can be used as the light irradiating device 8. A proper device, which can emit light having a property (such as wavelength) matching with the properties (such as light absorption property) of the photoreceptor, is selected from such light irradiating devices.

(Developing Device)

The developing device 3 is a center-feed developing device having a structure such that a reverse developing roller 11 and a forward developing roller 12 are opposed to the photoreceptor 1 while opposed to each other at an opposed position P. The reverse developing roller 11 rotates in the same direction as that of the photoreceptor 1 but moves in the direction opposite to that of the photoreceptor at the opposed position thereof to develops an electrostatic latent image on the photoreceptor 1 with a developer 13 (two component developer in this example). The forward developing roller 12 rotates in the direction opposite to that of the photoreceptor 1 but moves in the same direction as that of the photoreceptor at the opposed position thereof to develop an electrostatic latent image on the photoreceptor 1 with the developer 13.

In this regard, the developing rollers 11 and 12 are opposed to the photoreceptor 1 at respective opposed positions (i.e., developing regions), which are located on downstream sides from the opposed position P relative to the rotation directions of the developing rollers.

The developing device 3 further includes a developer layer thickness controlling member 15 configured to control the thickness of the developer layers formed on the surfaces of the developing rollers 11 and 12. Further, the developing device 3 optionally includes agitating members 14*a* and 14*b*. The developer layer thickness controlling member 15 is located on an upstream side from the opposed position P of the developing rollers 11 and 12 relative to the rotation directions of the developing rollers. Each of the developing rollers 11 and 12 has a magnetic force.

In this example, the developing device 3 has one reverse developing roller and one forward developing roller. However, the developing device is not limited thereto, and developing devices having three or more developing rollers can also be used as the developing device 3.

In the image forming method and apparatus, it is preferable that images are produced at a relatively high system speed (i.e., speed at which the receiving material 4 is fed) of from 500 to 2000 mm/sec. When image formation is performed at such a high system speed, an electrostatic latent image cannot be well developed with a developing device having only one magnetic developing roller, and a so-called center-feed developing device, which uses plural magnetic developing rollers to increase the area of the developing region (i.e., to increase the developing time), resulting in formation of images with a relatively high image density, is preferably used. Center-feed developing devices having plural magnetic developing rollers have higher developability than developing devices having only one magnetic developing roller, and can produce high density images even when the images have a large image area proportion.

(Transferring Device)

Any transferring devices, which can transfer a toner image on the photoreceptor 1 to the receiving material 4, can be used as the transferring device 5. Direct transferring devices, which directly transfer a toner image onto the receiving material 4, or indirect transferring devices, which transfer a toner image onto the receiving material 4 via an intermediate transfer medium, can be used as the transferring device 5.

(Fixing Device)

Known fixing devices using a fixing member such as fixing rollers and fixing belts can be used as the fixing device 6. However, in order to perform high speed image formation (high speed fixation), fixing devices using a fixing roller are preferably used. In addition, it is preferable to apply a silicone oil on the surface of the fixing member. An oil applicator (not shown in FIGURE) applies a silicone oil on the surface of the fixing member. Any known oil applicators, which can apply a silicone oil, can be used as the oil applicator. The oil applicator may be set inside the fixing device 6 or detachably set outside the fixing device. The silicone oil to be applied is not particularly limited, and any known silicone oils, which can improve the fixing property of the fixing member, can be used.

(Cleaning Device)

As mentioned above, high speed image formation is performed in the image forming method and apparatus of the present invention. In this regard, it is important that toner particles remaining on the photoreceptor 1 even after the transfer process are well removed stably by the cleaner 7. When such residual toner particles cannot be well removed from the photoreceptor 1, the residual toner particles fixedly adhere to the surface of the photoreceptor 1, resulting in formation of a toner film thereon (i.e., occurrence of the toner filming problem). A toner film formed on the photoreceptor causes white spots in solid images, resulting in deterioration of image qualities.

In order to prevent occurrence of the toner filming problem, it is preferably to optimally combine the toner and the cleaner.

The cleaner 7 includes one or more cleaning members such as cleaning brushes, cleaning blades, magnetic brushes and combinations thereof. In the image forming apparatus of the present invention, a cleaner including a cleaning brush is preferably used. The cleaning brush collects the residual toner particles, and the toner particles adhered to the brush are sucked by air suction. Therefore, the cleaner requires a high power, and the size of the cleaner becomes large. However, since such a brush cleaner has advantages such that the life is long, and residual toner particles can be well removed thereby, the cleaner can be preferably used.

The fibers of the cleaning brush are preferably made of a material such as nylon, triacetate, acryl and TEFLON®. Among these materials, nylon is preferably used because of having good cleanability and low costs.

(Toner)

In order to impart good fixing property (such as rubbing resistance) to the fixed image, the toner used for the image forming method and apparatus of the present invention includes at least a binder resin, a colorant, and a quaternary ammonium salt having the following formula (1):

Formula (1)

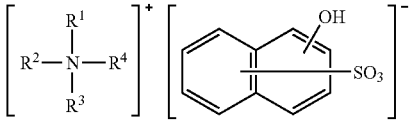

wherein each of $R^1$ to $R^4$ represents a substituted or unsubstituted hydrocarbon group having 1 to 25 carbon atoms, which is optionally branched.

It is preferable that each of $R^1$ to $R^4$ is an alkyl group having 1 to 25 carbon atoms. In addition, it is preferable that $R^4$ is a group such that a phenyl group is connected with an end of an alkylene group having 1 to 10 carbon atoms.

Specific examples of the quaternary ammonium salt having formula (1) include compounds having one of the following formulae (2) to (8):

Formula (2)

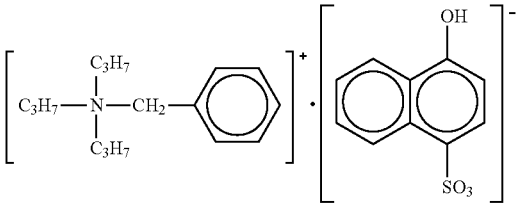

Formula (3)

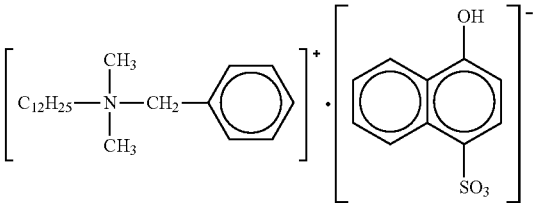

Formula (4)

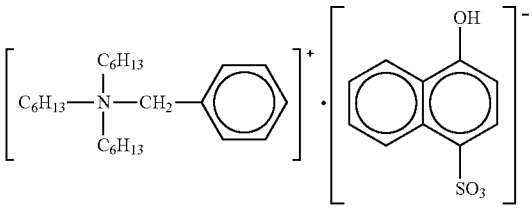

Formula (5)

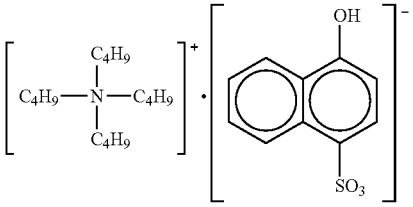

Formula (6)

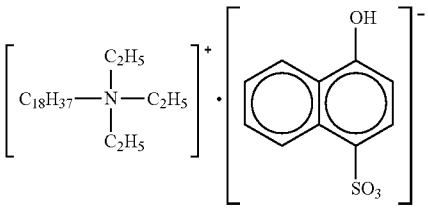

-continued

Formula (6)

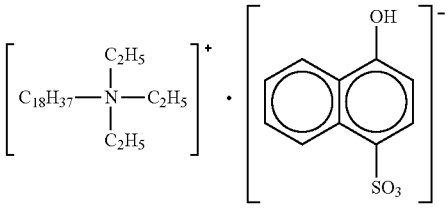

Formula (7)

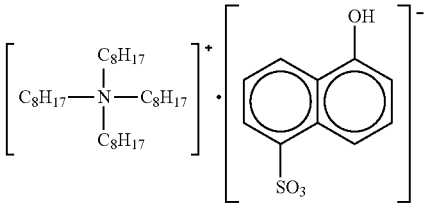

Formula (8)

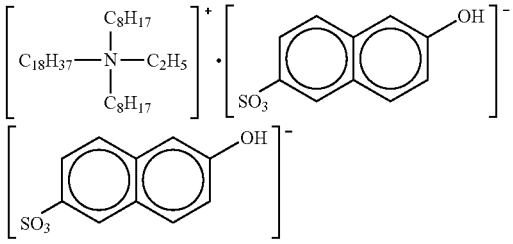

The added amount of the quaternary ammonium salt in the toner is preferably from 1.0 to 2.5 parts by weight per 100 parts by weight of the binder resin. When the added amount falls in this range, the fixing property of the toner image, particularly the rubbing resistance, can be enhanced, and thereby a problem in that a part of a fixed toner image is peeled when the toner image is rubbed, and the part of the fixed image is adhered to other members such as parts (such as feeding rollers) of the image forming apparatus and other receiving material sheets, resulting in contamination of the members.

When the content of the quaternary ammonium salt is too low, the fixing property cannot be well improved. In contrast, when the content is too high, another problem (contamination problem) in that the toner image has poor rubbing resistance because the quaternary ammonium salt itself has poor rubbing resistance, resulting in contamination of the other members is caused.

The toner of the present invention has a property such that when the toner is dispersed in ethanol using ultrasonic waves, the toner dispersion has a turbidity of from 0.4 to 1.0 when the turbidity is determined using a haze meter.

The method for measuring the turbidity is as follows.

At first, 1 gram of a toner is added to 10 grams of ethanol in a 30 ml screw vial container. The mixture is subjected to an ultrasonic treatment for 1 minute using an ultrasonic vibrator to prepare a toner dispersion. The thus prepared toner dispersion is filtered by suction filtering to obtain the filtrate (i.e., the liquid passing the filter). The transmittance (Tt) of the filtrate is measured with a haze meter. The turbidity (Th) of the toner is determined by the following equation:

$$Th=-\log(Tt/100).$$

When the turbidity of the toner is too small, the silicone oil applied to the fixing member and transferred to the surface of a toner image cannot be well borne on the surface of the toner image and penetrates into the toner image. In this case, the surface of the toner image has a large friction coefficient, and therefore the toner image has poor rubbing resistance, resulting in occurrence of the contamination problem in that the toner image is transferred to other members (such as backside of receiving material sheets, hands and cloths), resulting in contamination of the other members.

The turbidity increases as the content of the quaternary ammonium salt present on the increases. Therefore, when the turbidity is too high (i.e., the content of the quaternary ammonium salt is too high), the above-mentioned contamination problem in that the toner image has poor rubbing resistance because the quaternary ammonium salt itself has poor rubbing resistance, resulting in contamination of other members is caused.

The reason why the turbidity of toner relates to the fixing property of toner images is not clearly determined but it is considered that the quaternary ammonium salt present on the surface of a toner image improve the fixability of the toner image. Specifically, it is considered that the hydroxyl group of the quaternary ammonium salt present on the surface of a toner image interacts with an oxygen atom included in the silicone oil applied to the fixing member and transferred to the toner image, and thereby the silicone oil can be well borne on the surface of the fixed toner image. Therefore, the surface of the fixed toner image has low friction coefficient, and the fixed toner image has good rubbing resistance (i.e., good fixing property). However, when the amount of the quaternary ammonium salt present on the surface of the toner image is too large, the fixed toner image has poor rubbing resistance because the quaternary ammonium salt itself has poor rubbing resistance, resulting in occurrence of the contamination problem.

Thus, the amount of the quaternary ammonium salt present on the surface of the toner can be determined by measuring the turbidity of the toner. Therefore, by controlling the turbidity of the toner, the fixing property of the toner can be controlled.

The toner of the present invention is preferably a pulverization toner, which is prepared by a pulverization method. As mentioned above, the quaternary ammonium salt is preferably present on the surface of the toner to improve the fixing property of the toner. When the toner is prepared by a pulverization method (i.e., when the kneaded toner constituent mixture including at least a binder resin, a colorant and a quaternary ammonium salt is pulverized), the toner constituent mixture is mainly fractured at the quaternary ammonium salt domains because the quaternary ammonium salt is an organic compound and has relatively low mechanical strength. Thus, the quaternary ammonium salt is mainly present on the surface of the toner particles, and therefore the quaternary ammonium salt tends to remain at the surface of a fixed toner image. As mentioned above, quaternary ammonium salts have good affinity for silicone oils. Therefore, when a proper amount of quaternary ammonium salt is present on the surface of a toner image, the silicone oil applied to the fixing member and transferred on the toner image can be well borne on the surface of the fixed toner image, resulting in decrease of the friction coefficient of the fixed toner image and improvement of the fixing property (rubbing resistance) of the fixed toner image.

Next, the binder resin of the toner will be explained.

The toner of the present invention preferably includes a polyester resin as a binder resin. Suitable polyester resins include amorphous polyester resins and crystalline polyester resins. These polyester resins can be used alone or in combination.

Specifically, polycondensation polyester resins such as polyester resins (AX) prepared by subjecting a polyol and a polycarboxylic acid to a polycondensation reaction, and modified polyester resins (AY) prepared by reacting such a polyester resin (AX) with a compound such as polyepoxides (c) can be used as binder resins of the toner. These polyester resins (AX and AY) can be used alone or in combination.

Suitable polyols for use in preparing polyester resins include diols (g) and polyols (h) having three or more hydroxyl groups. Suitable polycarboxylic acids for use in preparing polyester resins include dicarboxylic acids (i) and polycarboxylic acids (j) having three or more carboxyl groups. These polyols can be used alone or in combination, and the polycarboxylic acids can also be used alone or in combination.

Specific examples of the polyester resins (AX) include linear polyester resins (AX1) which are prepared by using a dial (g) and a dicarboxylic acid (i); and non-linear polyester resins (AX2) which are prepared by using a dial (g), a dicarboxylic acid (i) and a polyol (h) and/or a polycarboxlic acid (j).

Specific examples of the modified polyester resins (AY) include modified polyester resins (AY1) which are prepared by reacting a non-linear polyester resin with a compound (c).

It is preferable for the dials (g) to have a hydraxyl value of from 180 to 1900 mgKOH/g. Specific examples of the dials (g) include alkylene glycols having 2 to 36 carbon atoms (e.g., ethylene glycol, 1,2-propylene glycol, 1,3-propylene glycol, 1,4-butylene glycol and 1,6-hexanediol); alkylene ether glycols having 4 to 36 carbon atoms (diethyleneglycol, triethyleneglycol, dipropylene glycol, polyethylene glycol, polypropylene glycol, and polybutylene glycol); alicyclic dials having 6 to 36 carbon atoms (e.g., 1,4-cyclohexane dimethanol, and hydrogenated bisphenol A); adducts of the above-mentioned alicyclic dials with an alkylene oxide having 2 to 4 carbon atoms such as ethylene oxides (EO), propylene oxides (PO) and butylenes oxides (BO) (the added amount of from 1 to 30 moles); adducts of bisphenols (e.g., bisphenol A, bisphenol F and bisphenol S) with an alkylene oxide having 2 to 4 carbon atoms such as ethylene oxides (EO), propylene oxides (PO) and butylenes oxides (BO) (the added amount of from 2 to 30 moles); etc.

Among these dials, alkylene glycols having 2 to 12 carbon atoms, alkylene oxide adducts of bisphenols, and mixtures thereof are preferably used, and alkylene oxide adducts of bisphenols, alkylene glycols having 2 to 4 carbon atoms, and mixtures thereof are more preferably used.

It is preferable for the polyols (h) having three or more hydroxyl groups to have a hydroxyl value of from 150 to 1900 mgKOH/g. Specific examples of the polyols (h) include aliphatic polyalcohols having three or more hydroxyl groups and 3 to 36 carbon atoms (e.g., alkanepolyols, and inner-molecular or inter-molecular anhydrous materials thereof such as glycerin, triethylolethane, pentaerythritol sorbitol, sorbitan, polyglycerin, and dipentaerythritol; saccharides and derivatives thereof such as saccharose and methylglucoside; etc.); adducts of the above-mentioned aliphatic polyalcohols with an alkylene oxide having 2 to 4 carbon atoms such as ethylene oxides (EO), propylene oxides (PO) and butylenes oxides (BO) (the added amount of from 1 to 30 moles); adducts of trisphenols (trisphenol PA) with an alkylene oxide having 2 to 4 carbon atoms such as ethylene oxides (EO), propylene oxides (PO) and butylenes oxides (BO) (the added amount of from 2 to 30 moles); adducts of novolac resins (phenol novolak and cresol novolac having an average polymerization degree of from 3 to 60) with an alkylene oxide having 2 to 4 carbon atoms such as ethylene oxides (EO), propylene oxides (PO) and butylenes oxides (BO) (the added amount of from 2 to 30 moles); etc.

Among these materials, aliphatic polyalcohols and alkylene oxide adducts (the added amount of from 2 to 30 moles) of novolac resins are preferably used, and alkylene oxide adducts of novolac resins are more preferably used.

It is preferable for the dicarboxylic acids (i) to have an acid value of from 180 to 1250 mgKOH/g. Specific examples of the dicarboxylic acids (i) include alkanedicarboxylic acids having 4 to 36 carbon atoms (e.g., succinic acid, adipic acid, and sebacic acid) and alkenylsuccinic acids (e.g., dodecenylsuccinic acid); alicyclic dicarboxylic acids having 4 to 36 carbon atoms (e.g., dimer acids (such as dimeric linolic acid); alkenedicarboxylic acids having 4 to 36 carbon atoms (e.g., maleic acid, fumaric acid, citraconic acid, and mesaconic acid); aromatic dicarboxylic acids having 8 to 36 carbon atoms (e.g., phthalic acid, isophthalic acid, terephthalic acid and naphthalenedicarboxylic acid); etc. Among these materials, alkanedicarboxylic acids having 4 to 20 carbon atoms and aromatic dicarboxylic acids having 8 to 20 carbon atoms are preferably used. Anhydrides and lower alkyl esters having 1 to 4 carbon atoms (such as methyl, ethyl and isopropyl esters) of the above-mentioned dicarboxylic acids can also be used as the dicarboxylic acids (i).

It is preferable for the polycarboxylic acids (j) having three or more carboxyl groups (three to six carboxyl groups or more carboxyl groups) to have an acid value of from 150 to 1250 mgKOH/g. Specific examples of the polycarboxylic acids (j) include aromatic polycarboxylic acids having 9 to 20 carbon atoms (e.g., trimellitic acid, and pyromellitic acid); copolymers of vinyl monomers and unsaturated carboxylic acids having a number average molecular weight (Mn) of from 450 to 10,000 determined by a gel permeation chromatography (GPC) (e.g., styrene-maleic acid copolymers, styrene-acrylic acid copolymers, α-olefin-maleic acid copolymers, and styrene-fumaric acid copolymers) etc. Among these materials, aromatic polycarboxylic acids having 9 to 20 carbon atoms are preferably used, and trimellitic acid and pyromellitic acid are more preferably used. Anhydrides and lower alkyl esters having 1 to 4 carbon atoms (such as methyl, ethyl and isopropyl esters) of the above-mentioned polycarboxylic acids can also be used as the polycarboxylic acids (j).

In the present application, the hydroxyl value and acid value are determined by the method described in JIS K 0070.

In addition, aliphatic or aromatic hydroxy carboxylic acids (k) having 4 to 20 carbon atoms and lactones (l) having 6 to 12 carbon atoms can be used (i.e., copolymerized) in combination with the above-mentioned diols (g), polyols (h), dicarboxylic acids (i) and polycarboxylic acids (j).

Specific examples of the hydroxycarboxylic acids (k) include hydroxystearic acid, hardened caster oil fatty acids, etc. Specific examples of the lactones (l) include caprolactone, etc.

Specific examples of the polyepoxides (c) include polyglycidyl ethers (e.g., ethylene glycol diglycidyl ether, tetramethylene glycol diglycidyl ether, bisphenol A diglycidyl ether, bisphenol F diglycidyl ether, glycerin triglycidyl ether, pentaerythritol tetraglycidyl ether, glycidyl ethers of phenol novolac (average polymerization degree of from 3 to 60); diene oxides (e.g., pentadiene dioxide, and hexadiene dioxide); etc. Among these materials, polyglycidyl ethers are preferably used, and ethylene glycol diglycidyl ether, and bisphenol A diglycidyl ether are more preferably used.

The number of epoxy groups included in a molecule of a polyepoxide (c) is preferably from 2 to 8, more preferably from 2 to 6, and even more preferably from 2 to 4.

The epoxy equivalent of the polyepoxides (c) is preferably from 50 to 500. The lower limit of the epoxy equivalent is more preferably 70 and even more preferably 80. The upper limit thereof is more preferably 300 and even more preferably 200.

When the number of epoxy groups or the epoxy equivalent falls in the respective ranges mentioned above, the resultant toner has a good combination of developing property and fixing property. It is more preferable that both the number of epoxy groups and the epoxy equivalent fall in the respective ranges mentioned above.

Suitable mixing ratio (i.e., an equivalent weight ratio [OH]/[COOH]) of a polyol to a polycarboxylic acid is from 2/1 to 1/2, preferably from 1.5/1 to 1/1.3 and more preferably from 1.3/1 to 1/1.2. It is preferable to select one or more polyols and one or more polycarboxylic acids such that the resultant polyester resin used as a binder resin of the toner has a glass transition temperature of from 45 to 85° C. while controlling the molecular weight of the polyester resin.

Amorphous polyester resins for use as binder resins of the toner of the present invention can be prepared by conventional methods for use in preparing popular polyesters. For example, monomers are subjected to a polycondensation reaction in an inactive gas atmosphere (such as nitrogen gas) using a titanium-containing catalyst (a) (such as titanium carboxylate) The reaction temperature is preferably from 150 to 280° C., more preferably from 160 to 250° C., and even more preferably from 170 to 240° C. The reaction time is preferably not shorter than 30 minutes, and more preferably from 2 hours to 40 hours in order to perfectly perform the polycondensation reaction. In addition, it is preferable to perform the reaction under a reduced pressure (e.g., 1 to 50 mmHg) in order to enhance the reaction speed at a late stage of the polycondensation reaction.

The added amount of a titanium-containing catalyst (a) for use in preparing a polyester resin is preferably from 0.0001 to 0.8% by weight, more preferably from 0.0002 to 0.6% by weight, and even more preferably from 0.0015 to 0.55% by weight, based on the weight of the resultant polyester resin.

Other esterification catalysts can be added in an amount such that the effect of the titanium-containing catalyst used is not lessened. Specific examples of such esterification catalysts include tin-containing catalysts (e.g., dibutyltin oxide), antimony trioxide, titanium-containing catalysts other than the titanium-containing catalysts (a) (e.g., titanium alkoxides, titanium potassium oxalate, titanium terephthalate) zirconium-containing catalysts (e.g., zirconyl acetate), germanium-containing catalysts, alkali (earth) metal catalysts (e.g., alkali metal salts or alkali earth metal salts of carboxylic acids such as lithium acetate, sodium acetate, potassium acetate, calcium acetate, sodium benzoate, and potassium benzoate), zinc acetate, etc. The added amount of such an esterification catalyst is preferably from 0 to 0.6% by weight based on the weight of the resultant polyester resin. In this case, coloring of the resultant polyester resin can be prevented, and therefore such a polyester resin can be preferably used for color toners. The content of a titanium-containing catalyst (a) in all the catalysts used is preferably from 50 to 100%.

An example of the method for preparing a linear polyester resin (AX1) is as follows. Specifically, a mixture of a diol (g) and a dicarboxylic acid (i) is heated to a temperature of from 180 to 260° C. in the presence of a titanium-containing catalyst (a) in an amount of from 0.0001 to 0.8% (and another catalyst, if desired) at a normal or reduced pressure to be subjected to a dehydration condensation reaction, resulting in formation of a linear polyester resin (AX1).

An example of the method for preparing a non-linear polyester resin (AX2) is as follows. Specifically, a mixture of a diol (g), a dicarboxylic acid (i) and a polyol (h) is heated to a temperature of from 180 to 260° C. in the presence of a titanium-containing catalyst (a) in an amount of from 0.0001 to 0.8% (and another catalyst, if desired) at a normal or reduced pressure to be subjected to a dehydration condensation reaction. Further, the reaction product is reacted with a polycarboxylic acid (j) to prepare a non-linear polyester resin (AX2). It is possible to react a diol (g), a dicarboxylic acid (i), a polyol (h) and a polycarboxylic acid (j) at the same time.

An example of the method for preparing a modified polyester resin (AY1) is as follows. Specifically, a polyepoxide (c) is added to a polyester resin (AX2), and the mixture is heated to a temperature of from 180 to 260° C. to perform a molecular chain growth reaction, resulting in formation of a modified polyester resin (AY1).

In this regard, the acid value of the polyester resin (AX2) used is preferably from 1 to 60 mgKOH/g, and more preferably from 5 to 50 mgKOH/g. When the acid value is not smaller than 1 mgKOH/g, occurrence of a problem in that the polyepoxide (c) remains without being reacted, thereby deteriorating the properties of the resultant polyester resin can be prevented. When the acid value is not larger than 60 mgKOH/g, the resultant polyester resin has good heat stability.

When a modified polyester resin (AY1) is prepared, the added amount of the polyepoxide (c) is preferably from 0.01 to 10% by weight, and more preferably from 0.05 to 5% by weight, based on the weight of the polyester resin (AX2) to impart a good combination of low temperature fixability and hot offset resistance to the resultant toner.

The toner of the present invention can include one or more resins other than the above-mentioned polycondensation polyester resins. Specific examples of such resins include styrene resins (e.g., styrene-alkyl(meth)acrylate copolymers, and styrene-diene monomer copolymers, epoxy resins (e.g., ring-opened polymers of bisphenol A diglycidyl ether), urethane resins (e.g., polyaddition reaction products of a diol and/or a polyol having three or more hydroxyl groups with a diisocyanate), etc.

The added amount of such resins other than polyester resins is preferably from 0 to 40% by weight, more preferably from 0 to 30% by weight, and even more preferably from 0 to 20% by weight, based on the total weight of the binder resin.

When two or more polyester resins are used as binder resins or a combination of one or more polyester resins and one or more other resins is used as binder resins, the resins can be previously mixed in the form of powder or mixed while melted. Alternatively, the resins may be mixed in combination with other toner constituents (such as colorants, release agents, and charge controlling agents) when toner particles are prepared. When the resins are melted to be mixed, the temperature is preferably from 80 to 180° C., more preferably from 100 to 170° C., and even more preferably from 120 to 160° C. When the mixing temperature is too low, the resins cannot be well mixed, and thereby the resins are unevenly present in the toner. When two or more polyester resins are melted at too high a temperature, an ester exchange reaction tends to occur, resulting in averaging of the resins. In this case, the resins cannot maintain the properties needed for the toner binder.

In the melt-mixing process, the mixing time is preferably 10 seconds to 30 minutes, more preferably from 20 seconds to 10 minutes, and even more preferably from 30 seconds to 5 minutes. When the mixing time is too long, an ester exchange reaction tends to occur, resulting in averaging of the resins. Therefore, the resins cannot maintain the properties needed for the toner bider.

Suitable mixing machines for use in the melt-mixing process include batch mixing machines such as reaction vessels, and continuous mixing machines. Among these mixing machines, continuous mixing machines are preferably used because materials can be evenly mixed at a proper temperature in a short time. Specific examples of the continuous mixing machines include extruders, continuous kneaders, three-roll mills, etc. Among these machines, extruders, and continuous kneaders are preferably used.

When powders (such as particulate resins) are mixed, mixing is performed under normal mixing conditions using popular mixing machines. For example, the mixing temperature is preferably from 0 to 80° C., and more preferably from 10 to 60° C. The mixing time is preferably not shorter than 3 minutes, and more preferably from 5 to 60 minutes. Specific examples of the mixing machines include HENSCHEL MIXER, NAUTER MIXER, BANBURY MIXER, etc. Among these mixers, HENSCHEL MIXER is preferably used.

(Colorant)

The toner of the present invention includes one or more colorants. Any known pigments and dyes capable of imparting a color such as yellow, magenta, cyan and black colors to the toner when used alone or in combination can be used.

Specific examples of the yellow-color pigments and dyes include Cadmium Yellow, Pigment Yellow 155, benzimidazolone, Mineral Fast Yellow, Nickel Titan Yellow, Naples Yellow, NAPHTHOL YELLOW S, HANSA YELLOW G, HANSA YELLOW 10G, BENZIDINE YELLOW GR, Quinoline Yellow Lake, PERMANENT YELLOW NCG, Tartrazine Lake, etc.

Specific examples of the orange-color pigments and dyes include Molybdenum Orange, PERMANENT ORANGE GTR, Pyrazolone Orange, VULVAN ORANGE, INDANTHRENE BRILLIANT ORANGE RK, BENZIDINE ORANGE G, INDANTHRENE BRILLIANT ORANGE GK, etc.

Specific examples of the red-color pigment and dyes include red iron oxide, Quinacridone Red, cadmium red, PERMANENT RED 4R, Lithol Red, Pyrazolone Red, Watchung Red calcium salt, Lake Red D, Brilliant Carmine 6B, Eosin Lake, Rhodamine Lake B, Alizarine Lake, Brilliant Carmine 3B, etc.

Specific examples of the violet-color pigments and dyes include Fast Violet B, and Methyl Violet Lake, etc.

Specific examples of the blue-color pigments and dyes include cobalt blue, Alkali Blue, Victoria Blue Lake, Phthalocyanine Blue, metal-free Phthalocyanine Blue, partially-chlorinated Phthalocyanine Blue, Fast Sky Blue, INDANTHRENE BLUE BC, etc.

Specific examples of the green-color pigments and dyes include Chrome Green, chromium oxide, Pigment Green B, Malachite Green Lake, etc.

Specific examples of the black-color pigments and dyes include carbon black, oil furnace black, channel black, lamp black, acetylene black, azine dyes such as aniline black, metal salts of azo dyes, metal oxides, complex metal oxides, etc.

These pigments and dyes can be used alone or in combination.

(Charge Controlling Agent)

The toner of the present invention can optionally include a charge controlling agent.

Specific examples of such charge controlling agents include Nigrosine, azine dyes having 2 to 16 carbon atoms (disclosed in published examined Japanese patent application No. (hereinafter referred to as JP-B) 42-1627), basic dyes (e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000)), and lake pigments of these basic dyes, C.I. Solvent Black 8 (C.I. 26150), quaternary ammonium salts (e.g., benzoylmethylhexadecylammonium chloride, and decyltrimethylammonium chloride, dialkyltin compounds (e.g., tibutyltin compounds, and dioctyltin compounds), dialkyltin borate compounds, guanidine derivatives, vinyl polymers having an amino group, condensation polymers having amino group (e.g., polyamine resins), metal complexes of monoazodyes disclosed in JP-Bs 41-20153, 43-27596, 44-6397, and 45-26478, metal complexes (e.g., Zn, Al, Co, Cr and Fe complexes) of carboxylic acids (e.g., salicylic acid, dialkylsalicylic acid, naphthoic acid, and dicarboxylic acids), which have been disclosed in JP-Bs 55-42752 and 59-7385, sulfonated copper phthalocyanine pigments, organic boron salts, fluorine-containing quaternary ammonium salts, calixarene compounds, etc. It is not preferable to use charge controlling agents having such a color as to deteriorate the color tone of color toners except for black toners. Namely, salicylic acid derivatives, which have a white color, are preferably used for color toners.

(Wax)

The toner of the present invention optionally includes a wax in such an amount that the wax does not lessen the effects of the toner of the present invention. Known waxes can be used for the toner of the present invention. Specific examples of the waxes for use in the toner of the present invention include low molecular weight polyolefin waxes such as polyethylene waxes and polypropylene waxes; synthesized hydrocarbon waxes such as Fischer Tropsch waxes; natural waxes such as beeswaxes, carnauba waxes, candelilla waxes, rice waxes, and montan waxes; petroleum waxes such as paraffin waxes and microcrystalline waxes; higher fatty acids such as stearic acid, palmitic acid and myristic acid, and metal salts and amides of these higher fatty acids; synthesized ester waxes; etc. In addition, modified versions of these waxes can also be used. The waxes mentioned above can be used alone or in combination.

Among these waxes, carnauba waxes, modified carnauba waxes, polyethylene waxes, and synthesized ester waxes can be preferably used, and carnauba waxes can be more preferably used. This is because the waxes can be relatively finely dispersed in polyester resins and polyol resins so as to have a proper particle diameter, and thereby a good combination of offset resistance, transferability and durability can be imparted to the toner.

The added amount of a wax is preferably from 2 to 15% by weight based on the total weight of the toner. When the added amount is too small, good offset resistance cannot be imparted to the toner. When the added amount is too large, transferability and durability of the toner deteriorate.

(Other Toner Constituents)

The toner of the present invention can include other toner constituents in such an amount that the constituents do not lessen the effects of the toner of the present invention.

In addition, the toner of the present invention can include an external additive such as particulate silica and titanium oxide, which is added to toner particles constituted of the above-mentioned toner constituents.

(Carrier)

When the toner of the present invention is used for a two-component developer, the toner is mixed with a carrier to prepare the developer. Known materials for use as conventional carriers can be used for the carrier. Specific examples thereof include iron powders, ferrite powders, magnetite powders, nickel powders, glass beads, etc., whose surface may be covered with a resin. The carrier preferably has a volume average particle diameter of from 25 to 200 μm.

(Method for Preparing the Toner)

As mentioned above, melt-kneading methods in which the toner constituents (such as binder resins, colorants, and quaternary ammonium salts, and optional release agents (waxes) and charge controlling agents) are melt-kneaded and then the kneaded mixture is pulverized to form toner particles (mother toner) are preferably used. However, the method for preparing the toner of the present invention is not limited thereto, and other methods can be used.

For example, polymerizing methods such as suspension or emulsion polymerization methods; addition polymerization methods using an isocyanate-containing prepolymer; methods in which toner constituents are dissolved or dispersed in a solvent, and then the solvent is removed therefrom, followed by pulverization to form toner particles; and melt spray methods in which melted toner constituents are sprayed to form toner particles, can also be used. Among these methods, suspension or emulsion polymerization methods in which a toner composition including a specific crystalline polymer and a polymerizable monomer is dispersed or emulsified in an aqueous medium, followed by polymerization to prepare toner particles; addition polymerization methods in which a toner composition liquid including a specific crystalline polymer and an isocyanate-containing prepolymer is dispersed or emulsified in an aqueous medium, followed by a polymer chain growth reaction and/or a crosslinking reaction using an amine to prepare toner particles; and the methods in which toner constituents are dissolved or dispersed in a solvent, and then the solvent is removed therefrom, followed by pulverization to form toner particles, are preferably used.

Suitable kneaders for use in the melt-kneading methods include batch kneaders such as two-roll mills, and BANBURY MIXER; continuous double-axis kneaders such as KTK double-axis extruders from Kobe Steel, Ltd., TEM double-axis extruders from Toshiba Machine Co., Ltd., double-axis extruders from KCK Co., PCM double-axis extruders from Ikegai Corp., and KEX double-axis extruders from Kurimoto, Ltd.; continuous single-axis kneaders such as KO-KNEADER from Buss AG; etc.

When the polymerization methods and the addition polymerization methods using an isocyanate-containing prepolymer are used, it is essential to perform a process in which a toner composition liquid is emulsified in an aqueous medium to form liquid droplets by applying mechanical energy thereto. Suitable machines capable of applying such mechanical energy include HOMOMIXER, machines using ultrasound, and high pressure homogenizers (MANTON GOLIN homogenizers), which can perform strong agitation or apply ultrasound vibration energy.

When pulverizing a block of toner (such as kneaded toner constituent mixture), it is preferable that at first, the toner block is crushed (roughly pulverized) with a coarse crusher such as hammer mills and ROTOPLEX, and the resultant powder (i.e., crushed material) is then pulverized with a fine pulverizer such as pulverizers using jet air and mechanical pulverizers. In this regard, it is preferable that the pulverized material has an average particle diameter of from 3 to 15 μm. The thus pulverized material is then classified with a classifier such as air classifiers so that the particle diameters of the resultant particles range from 5 to 20 μm.

The above-prepared toner particles (i.e., mother toner) are mixed with an external additive using a mixer while agitated. In this case, the external additive is dissociated and adhered to the surface of the toner particles. It is important to evenly and strongly adhere the external additive to the toner particles so that the resultant toner has good durability. Next, the mixture is preferably sieved using a screen with 250- or more-mesh to remove coarse particles and aggregated particles, resulting in formation of the toner of the present invention.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

[Synthesis of Polyester Resin]

The following components were fed in a reaction vessel equipped with a thermometer, an agitator, a condenser, and a nitrogen feed pipe to be mixed.

| | |
|---|---|
| Propylene oxide adduct of bisphenol A (hydroxyl value of 320 mgKOH/g) | 443 parts |
| Diethylene glycol | 135 parts |
| Terephthalic acid | 422 parts |
| Dibutyltin oxide | 2.5 parts |

The mixture was heated to 230° C. to be reacted. When the reaction product had an acid value of 7 mgKOH/g, the reaction was stopped. Thus, a polyester resin was prepared.

Example 1

[Preparation of Toner]

The following components were mixed for 3 minutes using a HENSCHEL MIXER mixer (HENSCHEL 20B, from Mitsui Mining Co., Ltd.), which was rotated at a revolution of 1500 rpm.

| | |
|---|---|
| Polyester resin prepared above | 100 parts |
| Carnauba wax (melting point of 81° C.) | 4 parts |
| Charge controlling agent (Nigrosine) | 2 parts |
| Compound having formula (2) mentioned above | 1 part |
| Carbon black | 6 parts |

The mixture was then kneaded using a single axis kneader (small-size CO-KNEADER from Buss AG) under the following conditions:

Preset temperature: 100° C. (at entrance), 50° C. (at exit)

Amount of mixture fed to kneader: 2 kg/hr

The kneaded toner constituent mixture thus prepared was then cooled by rolling, followed by rough pulverizing using a pulverizer to prepare a primary powder. Further, the primary powder is finely pulverized using a pulverizer (I type mill, IDS-2 from Nippon Pneumatic Mfg. Co., Ltd.) in which the primary powder is collided against a flat collision plate to be pulverized. The pulverization conditions are as follows.

| | |
|---|---|
| Pressure of air: | 6.5 atm/cm$^2$ |
| Amount of powder fed to mill: | 0.5 kg/hr |

The thus prepared secondary powder was classified using a classifier (132MP from Alpine AG) to prepare a mother toner (i.e., toner particles).

It was confirmed that the mother toner has a turbidity of 0.4.

The following components were mixed using a HENSCHEL MIXER mixer (MENSCHEL 20B, from Mitsui Mining Co., Ltd.).

| | |
|---|---|
| Mother toner prepared above | 100 parts |
| External additive | |
| Silica (treated with hexamethyldisilazane) | 0.5 parts |
| Titanium oxide (treated with silane coupling agent) | 0.5 parts |

In this regard, the mixing operation was performed by mixing the components for 30 seconds at a peripheral speed of 30 m/sec, and then stopping the mixer for 60 seconds. This mixing/pausing cycle was repeated 5 times.

Thus, a toner of Example 1 was prepared.

Example 2

The procedure for preparation of the toner in Example 1 was repeated except that the added amount of the compound No. 2 was changed from 1 part to 2.5 parts.

Thus, a toner of Example 2 was prepared.

Comparative Example 1

The procedure for preparation of the toner in Example 1 was repeated except that the added amount of the compound No. 2 was changed from 1 part to 0.8 parts.

Thus, a toner of Comparative Example 1 was prepared.

Comparative Example 2

The procedure for preparation of the toner in Example 1 was repeated except that the added amount of the compound No. 2 was changed from 1 part to 3.0 parts.

Thus, a toner of Comparative Example 2 was prepared.

Comparative Example 3

The procedure for preparation of the toner in Example 1 was repeated except that the air pressure in the pulverization process was changed from 6.5 to 5.9 atm/cm$^2$.

Thus, a toner of Comparative Example 3 was prepared.

Comparative Example 4

The procedure for preparation of the toner in Example 1 was repeated except that the air pressure in the pulverization process was changed from 6.5 to 7.1 atm/cm$^2$.

Thus, a toner of Comparative Example 4 was prepared.

Example 3

The procedure for preparation of the toner in Example 1 was repeated except that the compound having formula (2) was replaced with the compound having formula (3) mentioned above.

Thus, a toner of Example 3 was prepared.

[Preparation of Carrier]

The following components were subjected to a dispersing treatment for 10 minutes using a HOMOMIXER mixer.

| | |
|---|---|
| Silicone resin solution (solid content of 23% by weight) | 132.2 parts |
| Aminosilane (solid content of 100% by weight) | 0.66 parts |
| Particulate electroconductive material (alumina covered with a lower layer of tin dioxide and an upper layer of indium oxide including tin dioxide, and having an average particle diameter of 0.35 μm and powder resistivity of 3.5 Ω · cm). | 31 parts |
| Toluene | 300 parts |

The thus prepared cover layer coating liquid was coated on a core material, a calcined ferrite having an average particle diameter of 70 μm, using a coater, SPIRA COTA, so that the dried cover layer has a thickness of 0.15 μm. In this regard, the treatment temperature was 40° C. The coated carrier was then allowed to settle in an electric furnace, which is heated to 300° C., for 1 hour so as to be baked. After dried, the coated carrier was sieved using a screen having openings of 125 μm to prepare a carrier.

[Evaluation]

Each of the above-prepared toners (T) of Examples 1-3 and Comparative Examples 1-4 was mixed with the carrier (C) in a weight ratio (T/C) of 4/96 to prepare two component developers.

Each of the two component developers was set in an image forming apparatus, which has the structure as illustrated in FIGURE and which is a modified version of IMAGIO NEO C600 from Ricoh Co., Ltd., and a running test in which 100,000 copies of an original image are produced at a rate of 50,000 copies per day. The image forming conditions were as follows.

System speed (linear speed): 1700 mm/sec.

Gap between photoreceptor and developing rollers: 1.26 mm

Gap between doctor blade (developer layer thickness controlling member 15) and developing rollers: 1.6 mm Reflection photo-sensor in developing device: not used Rotation speed of cleaning brush: 1700 rpm Temperature of developing device: 30 to 48° C. (controlled)

Temperature of transferring device: 30 to 48° C. (controlled)

The system speed was determined as follows.

Specifically, 100 sheets of an A-4 size receiving paper are continuously fed in a portrait orientation such that the feeding direction of the sheet is parallel to the longer side thereof having a length of 297 mm to measure the total copying time A (seconds). The linear system speed (B) is defined by the following equation:

$$B\ (\text{mm/sec})=100\ (\text{sheets})\times 297\ (\text{mm})/A\ (\text{sec})$$

1. Evaluation of Fixability of Toner

An image recorded at the end of the running test was rubbed using a rubbing tester. Specifically, a paper sheet is attached to a head of the rubbing tester, and the image was rubbed with the paper sheet 20 times (i.e., 10 back and forth rubbing operations) at a speed of 3 mm/sec. The optical density of the surface of the paper rubbing the image was measured with a densitometer X-RITE 938 from X-Rite Corp. In this regard, the higher the optical density of the rubbing paper, the worse the fixing property of the toner image.

The fixing property of the toner was classified into the following two grades:

○: The optical density of the rubbing paper is not higher than 0.35.

x: The optical density of the rubbing paper is higher than 0.35.

The results are shown in Table 1.

TABLE 1

| | Added amount of quaternary ammonium salt (parts) | Air pressure (atm/cm$^2$) | Turbidity | Fixing property |
|---|---|---|---|---|
| Ex. 1 | 1.0 | 6.5 | 0.4 | ○ |
| Ex. 2 | 2.5 | 6.5 | 1.0 | ○ |
| Comp. Ex. 1 | 0.8 | 6.5 | 0.3 | X (poor fixing property) |
| Comp. Ex. 2 | 3.0 | 6.5 | 1.1 | X (contamination problem occurred due to the compound 2) |
| Comp. Ex. 3 | 1.0 | 5.9 | 0.3 | X (The amount of quaternary ammonium salt present on the surface of toner is small.) |
| Comp. Ex. 4 | 1.0 | 7.1 | 1.1 | X (contamination problem occurred due to the compound 2) |
| Ex. 3 | 1.0 | 6.5 | 0.4 | ○ |

It is clears from Table 1 that the toners of Examples 1-3 produce images having good fixing property even when high speed image formation is performed. In contrast, the toner of Comparative Example 1 produces images having poor fixing property. The toners of Comparative Examples 2 and 4 cause the contamination problem in that the quaternary ammonium salt compound is transferred and adhered, resulting in contamination of other members (such as backside of copied receiving material sheets, hands and cloths). In addition, the amount of the quaternary ammonium salt present on the surface of the toner of Comparative Example 3 is smaller than that in the case of toner of Example 1, and therefore the toner of Comparative Example 3 has poor fixing property.

This document claims priority and contains subject matter related to Japanese Patent Application No. 2008-236146, filed on Sep. 16, 2008, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method comprising:

forming an electrostatic latent image on a photoreceptor;

developing the electrostatic latent image with a developer including a toner using a center-feed developing device to prepare a toner image on a surface of the photoreceptor, wherein the center-feed developing device includes at least two developing rollers, which are opposed to the photoreceptor while opposed to each other and rotated in different directions and each of which has a magnetic force, and a developer layer thickness controlling member, which is located on an upstream side from an opposed position of the two developing rollers relative to rotation directions of the rollers and which is configured to control thicknesses of developer layers formed on surfaces of the developing rollers to develop the electrostatic latent image;

transferring the toner image onto a receiving material optionally via an intermediate transfer medium;

fixing the toner image on the receiving material with a fixing member, on which a silicone oil is applied; and cleaning the surface of the photoreceptor after transferring the toner image, wherein the toner comprises:

a binder resin;

a colorant; and a quaternary ammonium salt having the following formula (1):

Formula (1)

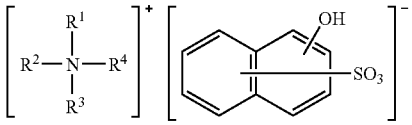

wherein each of R1 to R4 represents a substituted or unsubstituted hydrocarbon group having 1 to 25 carbon atoms, which is optionally branched, wherein when the toner is dispersed in ethanol using ultrasonic waves, the dispersion has a turbidity (Th) of from 0.4 to 1.0 when the turbidity (Th) is determined from the following equation:

$$Th=-\log(Tt/100),$$

wherein Tt represents a transmittance of the dispersion measured with a haze meter, and wherein the quaternary ammonium salt is included in the toner in an amount of from 1.0 to 2.5 parts by weight per 100 parts by weight of the binder resin.

2. The image forming method according to claim 1, wherein in formula (1), each of $R^1$ to $R^3$ represents an alkyl group having 1 to 25 carbon atoms, and $R^4$ represents an alkylene group, which has 1 to 10 carbon atoms and has a phenyl group at an end thereof.

3. The image forming method according to claim 1, wherein the toner is prepared by a method including:

subjecting toner constituents including at least the binder resin, colorant, and quaternary ammonium salt having formula (1) to a melt kneading treatment to prepare a kneaded toner constituent mixture;

cooling the kneaded toner constituent mixture;

crushing the cooled toner constituent mixture to prepare a primary powder;

pulverizing the primary powder to prepare a secondary powder using an air pulverizer, wherein the air pressure is from 6 to 7 atm/cm2, and classifying the secondary powder to prepare particles of the toner.

4. The image forming method according to claim 1, wherein the toner further comprises:

a charge controlling agent.

5. The image forming method according to claim 1, wherein the fixing member is a fixing roller.

6. The image forming method according to claim 1, wherein the receiving material is fed at a speed of from 500 to 2,000 mm/sec.

7. The image forming method according to claim 1, wherein R4 is a group such that a phenyl group is connected with an end of an alkylene group having 1 to 10 carbon atoms.

8. The image forming method according to claim 1, wherein the binder resin is a polyester resin.

9. The image forming method according to claim 1, wherein the binder resin is a polyester resin which has been reacted with a polyepoxide.

10. The image forming method according to claim 1, wherein the toner further comprises a wax.

* * * * *